US009206373B2

(12) United States Patent
McLaughlin et al.

(10) Patent No.: US 9,206,373 B2
(45) Date of Patent: Dec. 8, 2015

(54) CALCIUM NEUTRAL AND OVERBASED MANNICH AND ANHYDRIDE ADDUCTS AS DETERGENTS FOR ENGINE OIL LUBRICANTS

(71) Applicant: AFTON CHEMICAL CORPORATION, Richmond, VA (US)

(72) Inventors: Michael J. McLaughlin, Richmond, VA (US); Naresh Mathur, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 198 days.

(21) Appl. No.: 13/915,965

(22) Filed: Jun. 12, 2013

(65) Prior Publication Data

US 2014/0051619 A1 Feb. 20, 2014

Related U.S. Application Data

(60) Provisional application No. 61/684,167, filed on Aug. 17, 2012.

(51) Int. Cl.

| | |
|---|---|
| ***C10M 159/22*** | (2006.01) |
| ***C10M 173/02*** | (2006.01) |
| ***C07C 229/00*** | (2006.01) |
| ***C10M 133/16*** | (2006.01) |
| ***C10M 159/12*** | (2006.01) |
| ***C10M 159/16*** | (2006.01) |

(52) U.S. Cl.

CPC ..... *C10M 133/16* (2013.01); *C10M 159/12* (2013.01); *C10M 159/16* (2013.01); *C10M 159/22* (2013.01); *C10M 2207/12* (2013.01); *C10M 2207/122* (2013.01); *C10M 2207/123* (2013.01); *C10M 2207/126* (2013.01); *C10M 2207/127* (2013.01); *C10M 2215/042* (2013.01); *C10M 2215/08* (2013.01); *C10M 2217/043* (2013.01); *C10N 2210/01* (2013.01); *C10N 2210/02* (2013.01); *C10N 2230/04* (2013.01); *C10N 2230/06* (2013.01); *C10N 2230/12* (2013.01); *C10N 2230/42* (2013.01); *C10N 2230/43* (2013.01); *C10N 2230/45* (2013.01); *C10N 2240/10* (2013.01); *C10N 2240/102* (2013.01); *C10N 2270/00* (2013.01); *C10N 2270/02* (2013.01)

(58) Field of Classification Search

CPC ..... C10M 2217/043

USPC ..... 508/460, 508, 513; 562/450

See application file for complete search history.

(56) References Cited

U.S. PATENT DOCUMENTS

| | | | |
|---|---|---|---|
| 3,368,972 | A | 2/1968 | Otto |
| 3,381,002 | A | 4/1968 | Komeno et al. |
| 3,442,808 | A | 5/1969 | Traise et al. |
| 3,586,629 | A | 6/1971 | Otto et al. |
| 3,634,515 | A | 1/1972 | Piasek et al. |
| 3,649,229 | A | 3/1972 | Otto |
| 3,649,659 | A | 3/1972 | Otto et al. |
| 3,697,574 | A | 10/1972 | Piasek et al. |
| 4,131,551 | A | 12/1978 | Thompson et al. |
| 4,178,259 | A | 12/1979 | King |
| 4,234,435 | A | 11/1980 | Meinhardt et al. |
| 4,699,724 | A | 10/1987 | Nalesnik et al. |
| 4,713,189 | A | 12/1987 | Nalesnik et al. |
| 4,734,211 | A | 3/1988 | Kennedy |
| 5,128,056 | A | 7/1992 | Gutierrez et al. |
| 5,259,967 | A | 11/1993 | Ripple |
| 5,883,057 | A | 3/1999 | Roell, Jr. et al. |
| 5,958,848 | A | 9/1999 | Robson |
| 6,008,165 | A | 12/1999 | Shanklin et al. |
| 6,034,039 | A | 3/2000 | Gomes et al. |
| 6,153,565 | A | 11/2000 | Skinner et al. |
| 6,232,277 | B1 | 5/2001 | Ledeore et al. |
| 6,331,510 | B1 | 12/2001 | Curtis et al. |
| 6,521,571 | B1 | 2/2003 | Garner et al. |
| 6,569,818 | B2 | 5/2003 | Nakazato et al. |
| 6,727,208 | B2 | 4/2004 | Wilk |
| 6,784,143 | B2 | 8/2004 | Locke et al. |
| 7,049,273 | B2 | 5/2006 | Esche et al. |
| 7,256,161 | B2 | 8/2007 | Wollenberg et al. |
| 7,435,709 | B2 | 10/2008 | Stonebraker et al. |
| 7,585,820 | B2 | 9/2009 | Kleijwegt |
| 7,691,796 | B2 | 4/2010 | Adams et al. |
| 7,867,955 | B2 | 1/2011 | Conroy et al. |
| 7,906,470 | B2 | 3/2011 | Stevenson et al. |
| 8,242,066 | B2 | 8/2012 | Cheng et al. |
| 2005/0034360 | A1 | 2/2005 | Aradi et al. |
| 2007/0027057 | A1 | 2/2007 | Le Coent et al. |
| 2010/0256030 | A1 | 10/2010 | Hartley et al. |

FOREIGN PATENT DOCUMENTS

| | | | |
|---|---|---|---|
| EP | 0612839 | A1 | 8/1994 |
| JP | 06299185 | A1 | 10/1994 |

*Primary Examiner* — Vishal Vasisth

(74) *Attorney, Agent, or Firm* — Luedeka Neely Group, P.C.

(57) ABSTRACT

A sulfur-free metal or ammonium salt compound, a method of making the compound, and a lubricant additive concentrate, and lubricant composition containing the compound. The compound is made by reacting a phenolic compound reacted with an aldehyde and an amine, with a compound selected from the group consisting of an acylating agent and an electrophilic compound.

17 Claims, No Drawings

CALCIUM NEUTRAL AND OVERBASED MANNICH AND ANHYDRIDE ADDUCTS AS DETERGENTS FOR ENGINE OIL LUBRICANTS

This application claims benefit of 61/684,167, filed Aug. 17, 2012.

TECHNICAL FIELD

The disclosure relates to lubricant additives and in particular to sulfur-free detergent additives for crankcase lubricant compositions.

BACKGROUND AND SUMMARY

Lubricating oil compositions, as used in the internal combustion engines and transmissions of automobiles or trucks, are subjected to a demanding environment. This environment results in the lubricating oil composition suffering oxidation that is catalyzed by the presence of impurities in the lubricating oil composition, such as iron compounds. Additionally, oxidation of the lubricating oil composition is promoted by the elevated temperatures of the lubricating oil composition during use.

The oxidation of the lubricating oil composition during use is usually controlled to some extent by the use of additives, such as antioxidants or acid neutralizers, which may extend the useful life of the lubricating oil composition, particularly by reducing or preventing unacceptable viscosity increases.

Acid neutralizers generally used in lubricant compositions may be selected from metal alkyl phenates and metal alkylaryl sulfonates. The metal of the metal of the phenates and sulfonates may be selected from alkali and alkaline earth metals such as calcium, magnesium, sodium, or barium.

In recent years, phosphorus compounds and sulfur (from sulfonates, sulfur-containing phenates, and metal-containing dithiophosphates) derived from engine lubricants have been shown to contribute in part to particulate emissions. Also, sulfur and phosphorus tend to poison the catalysts used in catalytic converters, resulting in a reduction in performance of the catalysts.

Accordingly, there exists a need for improved lubricant compositions that have reduced levels of sulfur and phosphorus. By reduced levels is meant less than 1.0 wt. % phosphorus and less than 0.5 wt. % sulfur based on the total weight of the lubricant composition.

In view of the foregoing, an embodiment of the disclosure provides sulfur-free metal or ammonium salt compound, a method of making the compound, and a lubricant additive concentrate, and lubricant composition containing the compound. The compound is made by reacting a phenolic compound that has been reacted with an aldehyde and an amine, with a compound selected from the group consisting of an acylating agent or an electrophilic compound. The reaction product is then neutralized or overbased with a metal or ammonium compound.

In another embodiment, the disclosure provides a method for making a sulfur-free, metal or ammonium salt compound for use as a lubricant additive component. The method includes reacting (a) a phenolic compound with (b) an aldehyde, and (c) an amine to provide an intermediate product. The intermediate product is reacted with (d) a compound selected from the group consisting of an acylating agent or an electrophilic compound to provide a reaction product. The reaction product is then neutralized or overbased to provide the lubricant additive component.

DETAILED DESCRIPTION OF THE INVENTION

As set forth above, the present disclosure is directed to particular sulfur-free lubricant additive components derived from a condensation product of a phenolic compound, amine, and an aldehyde reacted with an acylating or electrophilic compound resulting in a reaction product that may be neutralized or overbased to provide the sulfur-free lubricant additive.

The term "overbased" or "overbasing" is used to describe alkaline earth metal alkyl salts of the reaction product in which the ratio of the number of equivalents of the alkaline earth metal moiety to the number of equivalents of the reaction product is greater than one. The ratio is usually greater than 1.2, but may be greater than 4.5. In comparison, the equivalent ratio of alkaline earth metal moiety to phenol moiety in conventional alkaline earth metal phenates is one to one.

The term "neutralized" or "neutralizing" is used to describe ammonium salts of the reaction product in which the ratio of the number of equivalents of the nitrogen containing moiety to the number of equivalents of the reaction product is equal to one.

The term "TBN" as employed herein is used to denote the Total Base Number in mg KOH/g as measured by the method of ASTM D2896.

The term "hydrocarbyl" as employed herein refers to both straight and branched saturated, unsaturated, and/or substituted chain radicals of from 1 to 100 carbon atoms.

The term "alkyl" as employed herein refers to straight, branched, and/or substituted saturated chain radicals of from 1 to 100 carbon atoms.

The term "alkenyl" as employed herein refers to straight, branched, and/or substituted unsaturated chain radicals of from 3 to 10 carbon atoms.

The term "aryl" as employed herein refers to single and multi-ring aromatic compounds that may include alkyl, alkenyl, alkylaryl, amino, hydroxyl, and alkoxy substituents.

The term "soluble" or "dispersible" refers to a component or composition that may be suspended or dissolved in a lubricating base oil such that it remains substantially suspended or dissolved in the oil without noticeable precipitation of the component or composition from the oil.

The Phenolic Compound

The phenolic compound may be represented by the following formula:

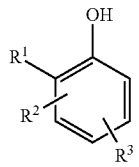

wherein $R^1$, $R^2$, and $R^3$ are independently selected from the group consisting of hydrogen, an alkyl group, an alkenyl group, an alkoxy group, an aminic group having from 1 to 24 carbon atoms, and an aryl group having from 6 to 24 carbon atoms. It is desirable that at least one of $R^1$, $R^2$, and $R^3$ have a sufficient number of carbon atoms such that the reaction product made with the phenolic compound is substantially soluble or dispersible in a lubricating oil composition. In one embodiment, the phenolic compound may be represented by the formula:

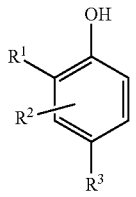

wherein $R^1$, $R^2$, and $R^3$ are defined as above. In another embodiment $R^2$ is a hydrogen atom. In yet another embodiment, $R^1$ and $R^2$ are hydrogen atoms and $R^3$ is a hydrocarbyl group containing from 1 to 24 carbon atoms. Exemplary phenolic compounds include, but are not limited to, p-cresol, 4-ethylphenol, 4-t-butyl-phenol, 4-t-amylphenol, 4-t-octylphenol, 4-dodecyl-phenol, 2,4-di-t-butylphenol, 2,4-di-t-amylphenol, and 4-nonylphenol.

Aldehyde

The aldehyde component can comprise, for example, formaldehyde, acetaldehyde, propanaldehyde, butryladehyde, hexyldehyde, heptaldehyde, and the like, with the most desirable being formaldehyde which may be used in its monomeric form or, more conveniently, in its polymeric form (i.e., paraformaldehyde).

Amine

Amines or nitrogen-containing compounds used for preparing Mannich base condensation product include ammonia, primary amines, secondary amine, or amides. Aliphatic amine, amine or polyamine (such as diethylenetriamine, triamine, tetramine and penta amine) including hydroxy may also be used. In one embodiment, the amine may be ethylenediamine. For example, the amine may be a straight or annular $C_2$-$C_6$ alkylene diethylenetriamine, triamine, tetramine, penta amine, polyamine, and their substituted multifunctional derivant. "Substituted derivant" as used herein refers to substituting with substituent, these substituents such as halo, hydroxy, alkoxy, nitryl, thio, alkoxycarbonyl and alkylthio.

The condensation reaction to prepare the intermediate products may proceed at temperatures from about 50° to about 200° C. with a suitable temperature range being about 75° to about 175° C. The time required for completion of the reaction usually varies from about 1 to about 8 hours, varying of course with the specific reactants chosen, the scale of the reaction, and the reaction temperature.

As to the molar range of phenolic compound, amine, and aldehyde which may be used to prepare the intermediate product, the range may fall within 0.5-5:1:0.5-5. An exemplary intermediate product may be the condensation product of nonylphenol:ethylenediamine:paraformaldehyde using a molar ratio of 2:1:2. The condensation reaction may be conducted in the presence of a catalyst. Suitable catalysts include, but are not limited to, any amine-containing catalyst or an acid. Examples of useful catalysts include 3-(dimethylamino)propylamine, ethylenediamine, and sulfuric acid. In one embodiment, the catalyst is 3-(dimethylamino)propylamine.

The amount of catalyst used in the condensation reaction may be about 0.2 to about 2%, by weight, based upon the weights of all components in the reaction mixture. A useful amount of catalyst is about 0.5 to about 1%, by weight, based upon the weights of all components in the reaction mixture.

In a second step of the reaction, the intermediate product may be reacted with an acylating agent or an electrophilic compound to provide a reaction product that may be neutralized or overbased to provide the sulfur-free lubricant additive. The acylating agents may be selected from mono-, di-, tri- and tetra-carboxylic acids and anhydrides that may contain a hydrocarbyl substituent. In one embodiment, the acylating agent may be an alkenyl succinic anhydride containing up to 32 carbon atoms. Unsaturated carboxylic reagents that may be used as acylating agents may include fatty acids and unsaturated carboxylic acids per se and functional derivatives thereof, such as anhydrides, esters, amides, imides, salts, acyl halides, and nitriles. Examples of useful unsaturated monobasic acids include, but are not limited to, acrylic acid, methacrylic acid, cinnamic acid, crotonic acid, and 2-phenylpropenoic acid. Polybasic unsaturated carboxylic acids include, but are not limited to, maleic acid, fumaric acid, mesaconic acid, itaconic acid, and citraconic acid; their anhydrides may be used. For example, in an embodiment maleic anhydride may be used. Reactive equivalents of such anhydrides include, but are not limited to, the above-mentioned derivative, e.g., acids, esters, half esters, amides, imides, salts, acyl halides, and nitriles, which may also serve as acylating agents. Another suitable acid may be glyoxylic acid. Reactive equivalents of glyoxylic acid, including esters and lactones may also be used. The total number of carbon atoms in the acylating agent may be 2 to 51, or 3 to 31, or 5 to 23, or 9, 11, or 13 to 21.

Suitable electrophilic compounds may be selected from compounds having a carbon atom doubly bonded to a heteroatom of the class consisting of oxygen, sulfur and nitrogen, whereby an electron-seeking chemical structural moiety or group is present to react with an anion of the aminic group or the intermediate product. In its organic compound classification, said terminating compounds will generally consist of 1 to 60 carbon atoms and contain electron-seeking group of the formula >C═X wherein X is oxygen, sulfur and nitrogen (either as NH or substituted. N), selium or tellurium and if desired may contain additional heteroatoms (to provide functionality) such as nitrogen, oxygen, sulfur, boron, phosphorous, silicon, lithium, etc. Accordingly, the electrophilic compound may contain a substituent group such as ketone, hydroxyl, ether, mercapto, sulfide, sulfoxide, sulfonyl, etc. Generally, such electrophilic compounds will contain about 1 to 60, for example, 1 to 30 carbon atoms and at least one electron-seeking group to create an electrophilic site.

One class of electrophilic compounds can be represented by the formula:

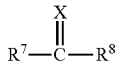

wherein X represents O, S or $NR^9$ and $R^7$, $R^8$, and $R^9$ may be the same or different and are individually selected from the group consisting of hydrogen, $C_1$ to $C_{30}$, for example, $C_1$ to $C_6$ straight and branched chain alkyl, arylalkyl, cycloalkyl, alkenyl, aryl-alkenyl and cycloalkenyl moieties and/or one or more reactive groups of the class consisting of alkyl unsaturation, carboxyl, epoxide, thiol, carbonyl, isocyanate, thionyl, amido, hydroxy, imino, acylhalide, halo, dicarboxylic acid anhydride, thiolic anhydride, thionic anhydride, dithionic anhydride, disubstituted amino, trisubstituted amino, ureido, isourea and dicarboxylamic acid anhydride or one-half of cyclic dicarboxylic acid anhydrides as in maleic anhydride or one-half of cyclic thiolic anhydride or one-half of cyclic thionic anhydride or one-half of cyclic dithionic anhydride or one-half of cyclic dicarboxylic amic acid anhydride or one-half of cyclic N C.sub.1-18 hydrocarbyl imides such as N-dodecylmalehnide.

Another useful class of electrophilic compounds may include $C_1$-$C_{20}$ acyclic compounds having a single electron-seeking group of the class consisting of carbonyl (>C═O), thiocarbonyl (>C═S), carbonimidonyl (>C═NH) and substituted carbonimidonyl (>C═$NR^{10}$ wherein $R^{10}$ is a polyalkylene-polyamiosubstituent containing from 2 to 8 carbons and from 1 to 4 nitrogens.

Suitable electrophilic compounds thus may be selected from ketones such as acetone, methylethyl ketone, diethyl ketone, dimethyl ketone, valerone, palmitone, stearone and ketoxime (nitrogen containing ketone, etc.; aldehydes such as acetaldehyde, formaldehyde, paraldehyde, propionaldehyde, lauric aldehyde, etc.; acid halides such as acetyl chloride, phosgene, carbamoyl chloride, methyl chloroformate, stearyl chloride, lauryl chloride, N,N-ditnethylcarbamoyl chloride, thiophosgene, thioacetyl chloride, etc.; other carbonyl and thiocarbonyl containing reagents such as urea, ethyl carbamate, O—ethyl thiocarbamate, hexanethiol, cyclohexane carbothialdehyde, thiobenzamine, etc.; and, acid anhydrides such as acetic anhydride, propionic anhydride, palmitic anhydride etc. Other electrophilic compounds may be selected from maleic anhydride and tetracyanoethylene.

Exemplary reaction products may include but are not limited to products having the following structures:

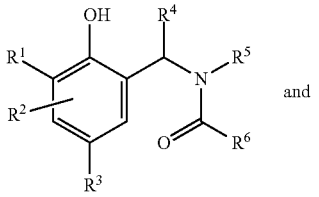

and

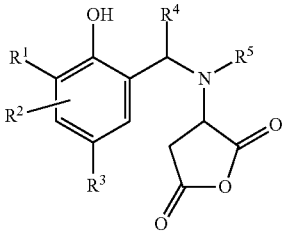

wherein $R^1$, $R^2$, and $R^3$ defined as above, $R^4$, $R^5$, and $R^6$ are selected from H, an alkyl group having from 1 to 24 carbon atoms, and an aryl group having from 6 to 24 carbon atoms. Other exemplary structures may include:

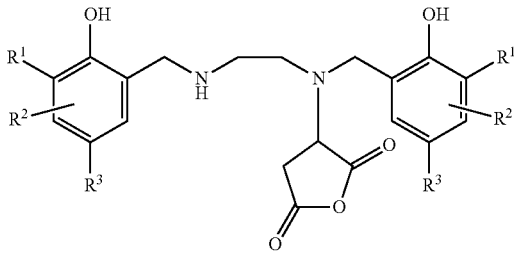

-continued

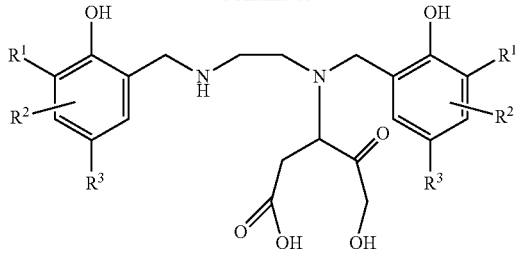

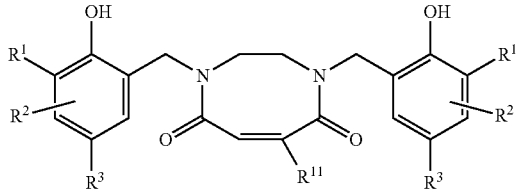

wherein $R^{11}$ is hydrogen

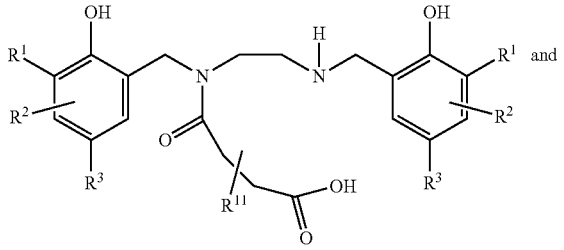

and

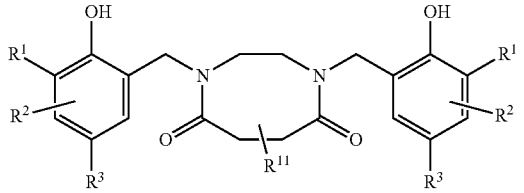

wherein $R^{11}$ is hydrogen or an alkyl group having from 1 to 24 carbon atoms.

In order to provide a useable sulfur-free lubricant additive, the reaction product may be further neutralized or overbased. Accordingly, the reaction product may be neutralized with an alkali or alkaline earth metal hydroxide or $NH_3$, a nitrogen-containing compound such as a primary, secondary, or tertiary amine having from 1 to 18 carbon atoms to form a neutral soap or the reaction product may be overbased by reaction with an alkali or alkaline earth metal oxide and carbon dioxide.

The alkali or alkaline earth metal may be selected from sodium, potassium, lithium, calcium, magnesium, zinc, barium. Alkaline earth metal source may suitably be an alkaline earth metal oxide or hydroxide, with the hydroxide being particularly useful. Useful alkaline earth metals may be selected from calcium and magnesium.

The amount of neutralizing or overbasing compound in the neutralizing or overbasing reaction will depend on a number of factors, including the nature of the reaction product and the amount of a base oil that can optionally be added to the overbasing mixture.

In a typical overbasing reaction, the weight ratio of the alkaline earth metal source to the reaction product in the overbasing reaction is 0.1-1:1. A useful weight ratio of the alkaline earth metal source to the reaction product in the overbasing reaction is 0.2-0.8:1. The alkaline earth metal source may be added to the initial reactants all at once, or part may be added to the initial reactants with the remainder being added in one or more portions at a subsequent stage or stages in the process.

Carbon dioxide may be added to the overbasing reaction in the form of a gas or a solid. A useful form of the carbon dioxide is a gas. When used in gaseous form, the carbon dioxide may suitably be blown through the overbasing reaction mixture at a flow rate of about 150 to about 300 cc/min for about 25 to about 90 minutes.

The $C_1$-$C_{20}$ monohydric alcohol, if present, can be used in an amount sufficient to provide up to about 30%, by weight, based upon the weights of all components added to the overbasing reaction mixture. Another amount of the $C_1$-$C_{20}$ monohydric alcohol is about 2 to about 20%, by weight, based upon the weights of all components added to the overbasing reaction mixture. A useful amount of the $C_1$-$C_{20}$ monohydric alcohol is about 4 to about 10%, by weight, based upon the weights of all components added to the overbasing reaction mixture. Examples of the $C_1$-$C_{20}$ monohydric alcohol include methanol, 2-ethylhexanol, cyclohexanol, and benzyl alcohol. A useful $C_1$-$C_{20}$ monohydric alcohol is 2-ethylhexanol.

Another component of the overbasing reaction may be a $C_2$-$C_4$ polyhydric alcohol, which may be present in an amount of from about 1 to about 10%, by weight, based upon the weights of all components added to the overbasing reaction mixture. A useful amount of $C_2$-$C_4$ polyhydric alcohol is about 1.5 to about 6%, by weight, based upon the weights of all components added to the overbasing reaction mixture. An example of a suitable $C_2$-$C_4$ polyhydric alcohol is a dihydric alcohol, such as ethylene glycol or propylene glycol. Another example of a suitable $C_2$-$C_4$ polyhydric alcohol is a trihydric alcohol, such as glycerol. A useful $C_2$-$C_4$ polyhydric alcohol is ethylene glycol.

In one embodiment, the neutralizing or overbasing reaction may be conducted in the presence of a base oil to yield a lubricating oil composition.

An exemplary neutralized product includes a compound having the following structure:

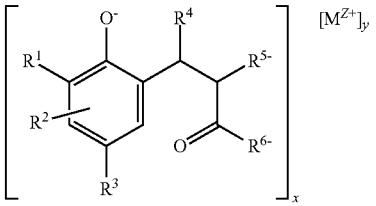

and an exemplary overbased product includes a compound with the following structure:

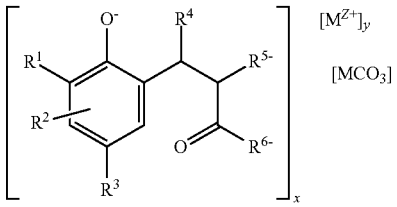

wherein M is an alkali or alkaline earth metal or $^{+}HN(R^{12})_3$ wherein $R^{12}$ is hydrogen or an alkyl group having from 1 to 6 carbon atoms, z is the valence M, and y and x are integers from 1 to 2.

Base Oil

The base oil used in the lubricating oil compositions herein may be selected from any of the base oils in Groups I-V as specified in the American Petroleum Institute (API) Base Oil interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II and III are mineral oil process stocks.

The base oil used in the inventive lubricating oil composition may be a mineral oil, animal oil, vegetable oil, synthetic oil or mixture thereof. Such oils include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale are also useful.

The amount of base oil that can optionally be added to the neutralizing or overbasing reaction should be sufficient to provide about 20 to about 80%, by weight, based upon the weights of all components added to the overbasing reaction mixture. A useful amount of base oil is about 40 to about 70%, by weight, based upon the weights of all components added to the neutralizing or overbasing reaction mixture.

The TBN of a lubricant additive containing the overbased or neutralized reaction product may range from about 0 to about 500. A useful TBN of the sulfur-free lubricant additive described herein may range from about 100 to about 400.

In addition to the sulfur-free lubricant additive component described herein, a lubricant compositions suitable for use in an internal combustion engine may also include other additives well-known in the art, such as polymeric viscosity modifiers, detergents, antioxidants, dispersants, rust inhibitors, antiwear agents, boron-containing compounds, friction modifiers, pour-point depressants, and antifoaming agents.

Polymeric viscosity modifiers reduce the rate of change of viscosity with temperature, i.e. they cause minimal increase in engine oil viscosity at low temperature but considerable increase at high temperature. The polymeric viscosity modifier, if present, may be used in an amount sufficient to provide up to about 12%, by weight, based upon the final weight of the lubricating oil composition. Another amount of the polymeric viscosity modifier that may be used is about 0.5 to about 10%, by weight, based upon the final total weight of the lubricating oil composition.

Examples of polymeric viscosity modifiers include polyolefins, polyisobutylenes, polymethacrylates, ethylene/propylene copolymers, polyacrylates, styrene/maleic ester copolymers, olefin copolymers, and hydrogenated styrene/butadiene copolymers. A useful polymeric viscosity modifier is a dispersant olefin copolymer.

The lubricating oil compositions herein also may optionally contain one or more additional detergents. The detergent, if present, may be used in an amount sufficient to provide up to about 10%, by weight, based upon the final weight of the lubricating oil composition. Another amount of the detergent that may be used is about 0.02 to about 2.5%, by weight, based upon the final weight of the lubricating oil composition.

The optional, additional detergents include metallic additives containing charged polar groups, such as sulfonates, phenates, carboxylates, salicylates, or phosphonates, with aliphatic, cycloaliphatic, or alkylaromatic chains, and several metal ions that will include at least one alkaline earth metal ion. The alkaline earth metal-containing detergent compound includes calcium, magnesium, barium and strontium salts imparting detergent action in a fuel-oil composition. Examples include neutral and overbased alkaline earth metal sulphonates, neutral and overbased alkaline earth metal salicylates, and neutral and overbased alkaline earth metal phenates. The detergents may include alkaline earth metal salts of petroleum sulphonic acids and long chain mono- or di-alkylarylsulphonic acids with each alkyl group comprising 12-18 carbon atoms and the aryl group being benzyl, tolyl, and xylyl. The detergents also may include alkaline earth metal phenates of alkylphenols and alkylmercaptophenols in which the linear or branched alkyl groups comprising from 4-50 carbon atoms and more particularly from 8-20 carbon atoms. Specific examples of the detergent include salts such as selected from the group consisting of neutral calcium sulphonate, neutral $C_{14}$-$C_{24}$ alphaolefin calcium sulfonate, overbased calcium sulphonate, overbased $C_{14}$-$C_{24}$ alphaolefin calcium sultanate, neutral calcium phenate, overbased calcium phenate, neutral calcium salicylate, overbased calcium salicylate, neutral magnesium sulphonate, overbased magnesium sulphonate, neutral magnesium phenate, overbased magnesium phenate, neutral magnesium salicylate, overbased magnesium salicylate, or combinations and mixtures thereof. It is desirable however, to avoid the use of detergents containing sulfur.

The lubricating oil compositions herein also may optionally contain one or more antioxidants. The antioxidant, if present, may be used in an amount sufficient to provide up to about 10% by weight, based upon the final weight of the lubricating oil composition. Another amount of the antioxidant that can be used is about 0.1 to about 4%.

Examples of antioxidants for use in lubricating oil compositions are well known and include a variety of chemical types including phenates, phenate sulfides, sulfurized olefins, phosphosulfurized terpenes, sulfurized esters, aromatic amines, phenols, and hindered phenols. Useful antioxidants include diarylamines and high molecular weight phenols. In one embodiment, the lubricating oil composition contains a mixture of a diarylamine and a high molecular weight phenol, such that each antioxidant is present in an amount sufficient to provide up to about 5%, by weight, based upon the final weight of the lubricating oil composition. In another embodiment, the antioxidant is a mixture of about 0.3 to about 1.5% diarylamine and about 0.4 to about 2.5% high molecular weight phenol, by weight, based upon the final weight of the lubricating oil composition. Like the detergents, it is desirable to a sulfur-free antioxidant.

The lubricating oil compositions herein also may optionally contain one or more dispersants. The dispersant, if present, can be used in an amount sufficient to provide up to about 12%, by weight, based upon the final weight of the lubricating oil composition. Another amount of the dispersant that can be used is about 3 to about 10%, by weight, based upon the final weight of the lubricating oil composition. In one embodiment, the lubricating oil composition utilizes a mixed dispersant system.

Dispersants used in lubricating oil compositions include primarily what are sometimes referred to as "ashless" dispersants because, prior to mixing in a lubricating oil composition, the dispersants do not contain ash-forming metals and the dispersants do not normally contribute any ash forming metals when added to a lubricating oil compositions. Dispersants are characterized by a polar group attached to a relatively high molecular weight hydrocarbon chain.

One class of dispersants is Mannich bases. Mannich bases are materials that are formed by the condensation of a higher molecular weight, alkyl substituted phenol, an alkylene polyamine, and an aldehyde such as formaldehyde. Mannich bases are described in more detail in U.S. Pat. No. 3,634,515.

Another class of dispersants is succinimide compounds. These materials are formed by the reaction of a hydrocarbyl-substituted succinic acylating agent and an amine. A more detailed description of succinimide compounds suitable for the lubricating oil compositions described herein is described in European Patent No. 976 814 and U.S. Pat. No. 4,234,435.

A third class of dispersants is high molecular weight esters. This class of dispersants is described in more detail in U.S. Pat. No. 3,381,022.

Other dispersants include polymeric dispersant additives, which are generally hydrocarbon-based polymers that contain polar functionality to impart dispersancy characteristics to the polymer.

A useful class of dispersants is the carboxylic dispersants. Carboxylic dispersants include succinic-based dispersants, which are the reaction product of a hydrocarbyl substituted succinic acylating agent with an organic hydroxy compound or, preferably, an amine containing at least one hydrogen attached to a nitrogen atom, or a mixture of said hydroxy compound and amine. The term "succinic acylating agent" refers to a hydrocarbon-substituted succinic acid or succinic acid-producing compound. Examples of succinic acylating agents include hydrocarbyl-substituted succinic acids, anhydrides, esters (including half esters) and halides.

The lubricating oil compositions herein may also optionally contain one or more rust inhibitors. The rust inhibitor, if present, can be used in an amount sufficient to provide up to about 5%, by weight, based upon the final weight of the lubricating oil composition.

The rust inhibitor may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of 600 to 3000 and alkenylsuccinic acids in which the alkenyl group contains 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful. A useful rust inhibitor is a high molecular weight organic acid.

The lubricating oil compositions herein may optionally contain one or more antiwear agents. The antiwear agent, if present, can be used in an amount sufficient to provide up to about 5%, by weight, based upon the final weight of the lubricating oil composition. Another amount of the antiwear agent that can be used is about 0.1 to about 5%, by weight, based upon the final weight of the lubricating oil composition.

Examples of antiwear agents include, but are not limited to, a metal thiophosphate, especially a zinc dialkyldithiophosphate, a phosphoric acid ester or salt thereof, a phosphite, and a phosphorus-containing carboxylic ester, ether, or amide. The phosphorus containing antiwear agents are more fully described in European Patent 612 839. A useful antiwear agent is zinc dialkylthiophosphate.

The lubricating oil compositions herein may optionally contain one or more boron-containing compounds. The boron-containing compound, if present, can be used in an amount sufficient to provide up to about 8%, by weight, based upon the final weight of the lubricating oil composition. Another amount of the boron-containing compound that can be used is about 0.5 to about 7%, by weight, based upon the final weight of the lubricating oil composition.

Examples of boron-containing compounds include borate esters, borated fatty amines, borated epoxides, and borated dispersants, such as borated succinimide dispersants, as disclosed in U.S. Pat. No. 5,883,057, columns 29-33. A useful boron-containing compound is a borated polyisobutylene succinimide dispersant that may optionally be capped with maleate.

The lubricating oil compositions herein may optionally contain one or more friction modifiers. The friction modifier, if present, can be used in an amount sufficient to provide up to about 5%, by weight, based upon the final weight of the lubricating oil composition. Another amount of the friction modifier that can be used is about 0.05 to about 1%, by weight, based upon the final weight of the lubricating oil composition.

Examples of friction modifiers include fatty amines, esters, especially glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids and polyalkylene-polyamines, amine salts of alkylphosphoric acids, and molybdenum-containing antioxidants or friction modifiers such as, but not limited to molybdenum dithiocarbamates, molybdenum amides, and molybdenum carboxylates. Among suitable molybdenum friction modifiers are molybdenum and sulfur-containing compositions derived from a molybdenum compound, a basic nitrogen-containing compound, and carbon disulfide. The basic nitrogen compound can be a hydrocarbyl amine or a reaction product of a carboxylic acid with an alkylene polyamine. The molybdenum compound can be an acidic molybdenum compound such as molybdic acid. Molybdenum-containing sulfur-free compounds are also useful herein. A useful friction modifier is glycerol monooleate.

The lubricating oil compositions herein may optionally contain one or more pour point depressants. The pour point depressant, if present, can be used in an amount sufficient to provide up to about 1%, by weight, based upon the final weight of the lubricating oil composition. Another amount of the pour point depressant that can be used is about 0.04 to about 0.5%, by weight, based upon the final weight of the lubricating oil composition. A useful pour point depressant is polymethylmethacrylate.

The lubricating oil compositions herein may optionally contain one or more antifoaming agents. The antifoaming agent, if present, can be used in an amount sufficient to provide up to about 1%, by weight, based upon the final weight of the lubricating oil composition. Another amount of the antifoaming agent that can be used is about 0.001 to about 0.015%, by weight, based upon the final weight of the lubricating oil composition. A useful antifoaming agent is a siloxane.

The TBN of the lubricating oil compositions containing the optional additives, described herein, may range from about 2 to about 20. A useful TBN of the lubricating oil compositions containing the optional additives described herein may range from about 5 to about 12.

In general terms, a suitable engine lubricant may include additive components in the ranges listed in the following table.

TABLE 2

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free phosphorus compound | 0.0-6.0 | 0.0-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

The percentages of each component above represent the weight percent of each component, based upon the weight of the final lubricating oil composition. The remainder of the lubricating oil composition consists of a base oil.

The lubricating oil compositions presented herein have about 12 to about 1.8 wt. % sulfated ash (ASTM D874); about 0.03 to about 0.1 wt. %, by weight, elemental phosphorous; and about 0.2 to about 0.4 wt. % sulfur.

The lubricating oil compositions presented herein are particularly effective as engine lubricating oils having enhanced antiwear properties. These lubricating oil compositions are effective in a variety of applications, including crankcase lubricating oil compositions for spark-ignited and compression-ignited internal combustion engines, such as automobile and truck engines, two-cycle engines, aviation piston engines, marine engines, low-load diesel engines, and heavy duty diesel engines.

The foregoing sulfur-free lubricant additive may be added directly to the base oil to form the lubricating oil composition. In one embodiment, however, the sulfur-free lubricant additive and, optionally, one of the other additives described above, are diluted with a substantially inert, normally liquid organic diluent such as mineral oil, synthetic oil, naphtha, alkylated (e.g., $C_{10}$-$C_{13}$ alkyl) benzene, toluene or xylene to form a lubricating oil concentrate. The lubricating oil concentrate usually contains from about 1% to about 99% by weight, and in one embodiment 10% to 90% by weight of the diluent. The lubricating oil concentrate may be added to the base oil to form the lubricating oil composition.

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the invention. All patents and publications cited herein are fully incorporated by reference herein in their entirety.

EXAMPLE 1

Alkylsuccinic Anhydride/Mannich Adduct 1a

Dodecylphenol (262 grams, 1.00 mole), process oil (305 grams) and ethylenediamine (33.1 grams, 0.55 mole) were charged to a reactor. Aqueous formaldehyde solution (89.3 grams of 37 wt % solution, 1.10 mole) was added subsurface to the reactor. The temperature was increased to 105° C. and a nitrogen sparge was started. After 3 hours the nitrogen sparge was removed and the temperature was increased to 150° C. and vacuum (28" Hg) was applied to the reaction mixture for 1 hour. Process oil (407 grams) was added to the reactor followed by addition of alkylsuccinic anhydride (407 grams, 1.00 mole) and the reaction mixture was heated at 150° C. for 1 hour. Vacuum was applied to the reactor for 30 minutes. At the end of the reaction time, 1400 grams of alkylsuccinic anhydride/Mannich Adduct 1a were obtained having the following formula.

1a

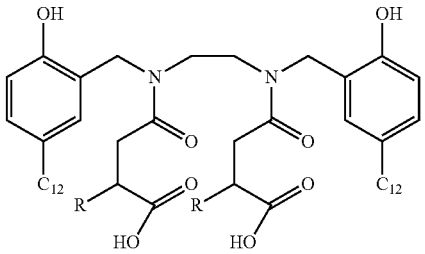

EXAMPLE 2

Overbased Alkylsuccinic Anhydride/Mannich Adduct 1a

Hexane (170 grams), 72 grams methanol (72 grams), and calcium oxide (35 grams, 0.63 mole) were charged to a 4-neck reactor. Adduct 1a from EXAMPLE 1 (156 grams 0.055 mole) was charged to the reactor. Ammonium hydroxide (8 grams) and water (3 grams) were charged to the reactor and $CO_2$ was bubbled into the reaction mixture while stirring rapidly. Once $CO_2$ uptake was complete, the reaction temperature was ramped to 150° C. and the solvents were removed. Vacuum was applied to the reactor for an additional 15 minutes and the products were filtered through a porous fiberglass filter. The resulting product had a TBN of 142 (ASTM 2896) and a weight percent Ca of 4.61.

EXAMPLE 3

Neutral salt of Alkylsuccinic Anhydride/Mannich Adduct 1a

Adduct 1a from EXAMPLE 1 (100 grams, 0.035 mole), toluene (100 grams), ethylene glycol (2 grams), water (10 grams) and calcium hydroxide (8.0 grams, 0.11 mole) were charged to a reactor and heated to 100° C. After 20 hours, the solvents were removed under reduced pressure at 150° C. The products were vacuum-filtered through filter aid. The resulting product had a TBN of 108 (ASTM 2896) and a weight percent Ca of 2.65.

EXAMPLE 4

Alkylsuccinic Anhydride/Mannich Adduct 1b

Dodecylphenol (262 grams, 1.00 mole), process oil (305 grams) and ethylenediamine (33.1 grams, 0.55 mole) were charged to a reactor. Aqueous formaldehyde solution (89.3 grams of 37 wt % solution, 1.10 mole) was added subsurface to the reactor. The temperature was increased to 105° C. and a nitrogen sparge was started. After 3 hours the nitrogen sparge was removed and the temperature was increased to 150° C. and vacuum (28" Hg) was applied to the reactor for 1 hour. Process oil (305 grams) was added to the reactor followed by addition of alkylsuccinic anhydride (305 grams, 0.75 mole) and the reaction mixture was heated at 150° C. for 1 hour. Vacuum was applied to the reactor for 30 minutes. At the end of the reaction time, 1200 grams of a mixture of alkylsuccinic anhydride/Mannich Adduct 1b was obtained having the following formulas.

1b

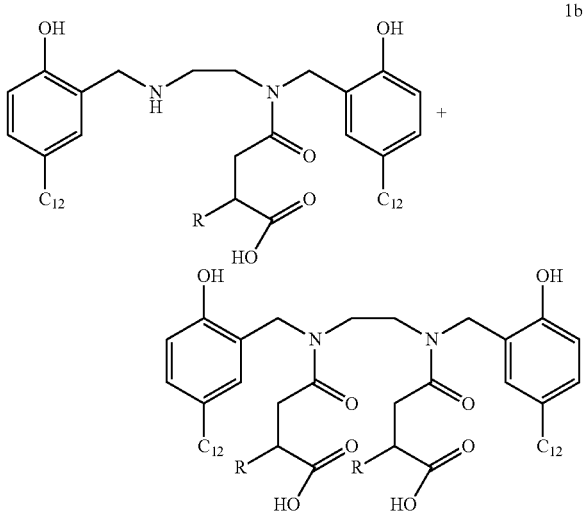

EXAMPLE 5

Ammonium Salt of Alkylsuccinic Anhydride/Mannich Adduct 1b

Adduct 1b from EXAMPLE 4 (115 grams, 0.047 mole) was charged to a reactor and heated to 75° C. While ramping the reactor to 75° C., triethylamine (11.9 grams, 0.12 mole) was added portionwise to the reactor. After 2 hours, the temperature was increased to 100° C. Vacuum was applied to the reactor for 30 minutes. The reaction product had 1.67 wt. % N and a TBN of 29 (ASTM 2896).

EXAMPLE 6

Alkylsuccinic Anhydride/Mannich Adduct 2

Dodecylphenol (50 grams, 0.19 mole), process oil (170 grams) and diethylenetriamine (9.8 grams, 0.095 mole) were charged to a reactor. Aqueous formaldehyde solution (16 grams of 37 wt % solution, 0.19 mole) was added subsurface to the reactor. The temperature was increased to 105° C. and a nitrogen sparge was started. After 3 hours the nitrogen sparge was removed and the temperature was increased to 120° C. and vacuum (28" Hg) was applied for 1 hour. Alkylsuccinic anhydride (114 grams, 0.28 mole) was added and heated at 150° C. for 1 hour. Vacuum was applied to the reaction mixture for 30 minutes, providing 342 grams of alkylsuccinic anhydride/Mannich Adduct 2 having the following formula.

2

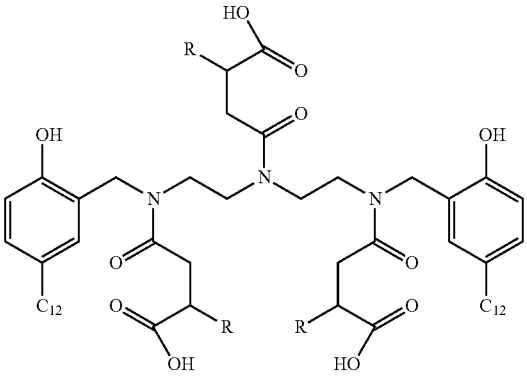

EXAMPLE 7

Neutral Salt of Alkylsuccinic Anhydride/Mannich Adduct 2

Adduct 2 (86 grams, 0.024 mole) and process oil (86 grams) were charged to a reactor and toluene (100 grams), ethylene glycol (10 grams), water (10 grams) and calcium hydroxide (7.0 grains, 0.095 mole) were added to a reactor. The reaction mixture was heated to 105° C. After 20 hours, the solvent was removed under reduced pressure at 150° C. The products were vacuum filtered through filter aid. The reaction product had a TBN of 45 (ASTM 2896) and weight percent Ca of 1.47.

EXAMPLE 8

Alkylsuccinic Anhydride/Mannich Adduct 3a

Dodecylphenol (50 grams, 0.19 mole), process oil (180 grams) and oleylamine (51 grams, 0.19 mole) were charged to a reactor. Aqueous formaldehyde solution (16 grams of 37 wt. % solution, 0.19 mole) was added subsurface to the reactor. The temperature was increased to 105° C. and a nitrogen sparge was started. After 3 hours the nitrogen sparge was removed and the temperature was increased to 120° C. and vacuum (28" Hg) was applied for 1 hour. Alkylsuccinic anhydride (76 grams, 0.19 mole) was added and the reaction mixture was heated at 150° C. for 1 hour. Vacuum was applied, for 30 min, providing 324 grams of alkylsuccinic anhydride/Mannich Adduct 3a having the following formula.

3a

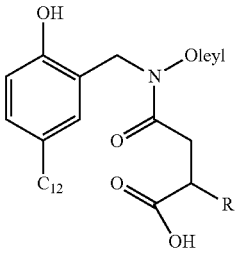

EXAMPLE 9

Neutral Salt of Alkylsuccinic Anhydride/Mannich Adduct 3a

Adduct 3a (116 grams, 0.061 mole) and toluene (100 grams), ethylene glycol (10 grams), water (10 grams) and calcium hydroxide (8.0 grams, 0.12 mole) were added to a reactor. The reaction mixture was heated to 105° C. After 20 hours, the solvent was removed under reduced pressure at 150° C. The product was vacuum filtered through filter aid. The reaction product had a TBN of 70 (ASTM 2896) and weight percent Ca of 2.32.

EXAMPLE 10

Maleic Anhydride/Mannich Adduct 3b

Dodecylphenol (75 grams, 0.29 mole), process oil (180 grams) and oleylamine (75 grams, 0.29 mole) were charged to a reactor. Aqueous formaldehyde solution (24 grams of 37 wt % solution, 0.30 mole) was added subsurface to the reactor. The temperature was increased to 105° C. and a nitrogen sparge was started. After 3 hours the nitrogen sparge was removed, and the temperature was increased to 140° C. and vacuum (28" Hg) was applied for 1 hour. Maleic anhydride (29 grams, 0.29 mmole) was added and the reaction mixture was heated at 140° C. for 1 hour. Vacuum was applied for 30 min, providing 365 grams of maleic anhydride/Mannich Adduct 3b having the following formula.

3b

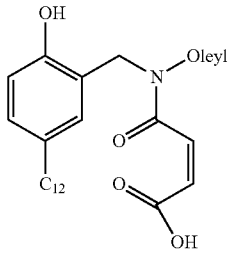

EXAMPLE 11

Neutral Salt of Maleic Anhydride/Mannich Adduct 3b

Adduct 3b (90 grams, 0.071 mole) and 15 grams process oil, toluene (100 grams), ethylene glycol (10 grams), water (10 grams) and calcium hydroxide (10 grams, 0.14 mole) were added to a reactor. The reaction mixture was heated to 105° C. After 20 hours, the solvent was removed under reduced pressure at 150° C. The reaction product was vacuum filtered through filter aid. The reaction product had a TBN of 68 (ASTM 2896) and weight percent Ca of 1.67.

EXAMPLE 12

Alkylsuccinic Anhydride/Mannich Adduct 4

P-cresol (108 grams, 1.00 mole), process oil (570 grams) and ethylenediamine (31.6 grams, 0.53 mole) were charged to a reactor. Aqueous formaldehyde solution (85.2 grams of 37 wt % solution, 1.05 mole) was added subsurface to the reactor. The temperature of the reaction mixture was increased to 105° C. and a nitrogen sparge was started. After 3 hours the nitrogen sparge was removed and the temperature was increased to 150° C. and vacuum (28" Hg) was applied to the reaction mixture for 1 hour. Alkylsuccinic anhydride (407 grams, 1.00 mole) was added and the reaction mixture was heated at 150° C. for 1 hour. Vacuum was applied for 30 min, providing 1090 grams of alkylsuccinic anhydride/Mannich Adduct 4 having the following formula.

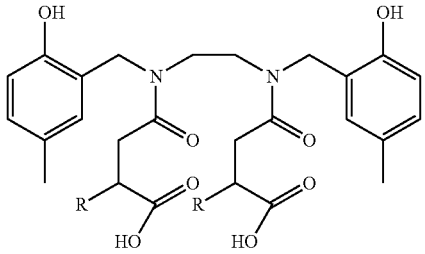

EXAMPLE 13

Neutral Salt of Alkylsuccinic Anhydride/Mannich Adduct 4

Adduct 4 (250 grams, 0.057 mole) was subjected to overbasing similar to the conditions used for Adduct 1a. However, a neutral calcium salt having a TBN of 68 (ASTM 2896) and weight percent Ca of 2.07, was obtained exclusively.

EXAMPLE 14

Alkylsuccinic Anhydride/Mannich Adduct 5

2,4-dimethylphenol (122 grams, 1.00 mole), process oil (475 grams) and ethylenediamine (33.1 grams, 0.55 mole) were charged to a reactor. Aqueous formaldehyde solution (89.3 grams of 37 wt % solution, 1.10 mole) was added subsurface to the reactor. The temperature was increased to 105° C. and a nitrogen sparge was started. After 3 hours the nitrogen sparge was removed and the temperature was increased to 150° C. and vacuum (28" Hg) was applied to the reaction mixture for 1 hour. Alkylsuccinic anhydride (305 grams, 0.75 mole) was added to the reaction mixture and the reaction mixture was heated at 150° C. for 1 hour. Vacuum was applied for 30 min, providing 92.0 grams of a mixture of alkylsuccinic anhydride Adduct 5 having the following formulas.

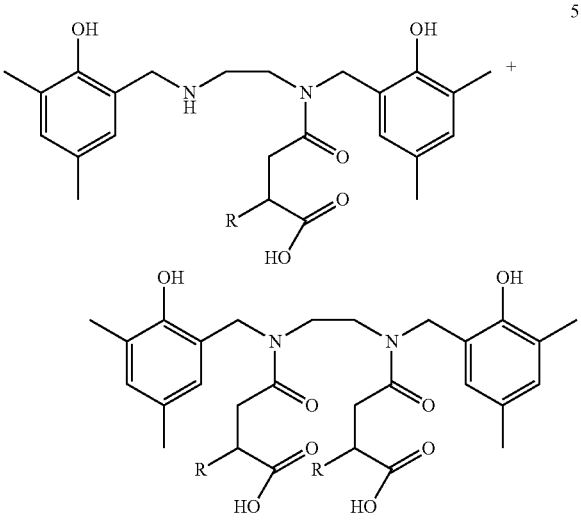

EXAMPLE 15

Neutral Salt of Alkylsuccinic Anhydride/Mannich Adduct 5

Adduct 5 (152 grams, 0.081 mole) was subjected to overbasing similar to the conditions used for Adduct 1a. However, a neutral calcium salt having a TBN of 52 (ASTM 2896) and weight percent Ca of 1.42, was obtained exclusively.

EXAMPLE 16

Four lubricating oil compositions were prepared for comparison of copper, tin and lead corrosion by a High Temperature Corrosion Bench Test (HTCBT). Fluid A was a typical 15W40 heavy duty diesel engine oil composition using conventional additive components in base oil. Fluid B was a similar composition to Fluid A except that Fluid B had no detergent additives. Fluid C was a similar composition to Fluid B with added 4 wt. % overbased Adduct 1a. As seen in Table 3, Fluid C showed a significant improvement in lead and copper corrosion compared to Fluid A containing conventional additive components. The results are shown in the following table. Wt. % Ca and TBN were determined prior to testing in HTCBT.

TABLE 3

| Fluid | TBN | VWT. % Ca | Cu (ppm) | Pb (ppm) | Sn (ppm) |
|---|---|---|---|---|---|
| A | 10 | 0.217 | 20 | 61 | 6 |
| B | 3.3 | 0.0001 | 126 | 12 | 3 |
| C | 9.2 | 0.148 | 12 | 15 | 7 |

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent an disclosed modifications or alterations may not literally fall within the scope of the claims, they are considered to be part hereof under the doctrine of equivalents.

What is claimed is:

1. A sulfur-free salt compound comprising a reaction product of:

(a) an intermediate product of a phenolic compound, an aldehyde and an amine, wherein the phenolic compound comprises a compound of the formula:

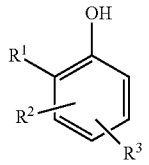

wherein $R^1$, $R^2$, and $R^3$ are independently selected from the group consisting of hydrogen, an alkyl group, an alkenyl group, an alkoxy group, an aminic group having from 1 to 24 carbon atoms, and an aryl group having from 6 to 24 carbon atoms; with (b) a compound selected from the group consisting of an acylating agent, an electrophilic compound, and mixtures thereof, and (c) a compound selected from an alkali or alkaline earth metal and a nitrogen-containing compound to provide an overbased or neutral sulfur-free salt compound.

2. The sulfur-free salt compound of claim 1, wherein the aldehyde comprises formaldehyde.

3. The sulfur-free salt compound of claim 1, wherein the amine comprises a mono- or polyamine.

4. The sulfur-free salt compound of claim 1, wherein component (b) is selected from the group consisting of maleic acid or anhydride, succinic acid or anhydride, alkenyl succinic acid or anhydride, and halo-carboxylic acid.

5. The sulfur-free salt compound of claim 1, wherein compound (c) is selected from alkali and alkaline earth metals.

6. The sulfur-free salt compound of claim 5, wherein the sulfur-free salt compound is overbased to provide calcium or magnesium salt of the reaction product.

7. The sulfur-free salt compound of claim 1, wherein the sulfur-free salt compound is a neutral ammonium salt of the reaction product.

8. A lubricant composition comprising a base oil and from about 1 to about 5 wt. % of the sulfur-free salt compound of claim 1.

9. A method for making a sulfur-free salt compound for use as a lubricant additive component comprising:

reacting a phenolic compound with an aldehyde, and an amine to provide an intermediate product, wherein the phenolic compound comprises a compound of the formula:

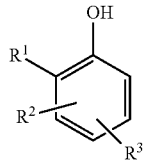

wherein $R^1$, $R^2$, and $R^3$ are independently selected from the group consisting of hydrogen, an alkyl group, an alkenyl group, an alkoxy group, an aminic group having from 1 to 24 carbon atoms, and an aryl group having from 6 to 24 carbon atoms;

subsequently reacting the intermediate product with (b) a compound selected from the group consisting of an acylating agent, an electrophilic compound, and mixtures thereof to provide a reaction product adduct, and neutralizing or overbasing the reaction product adduct with (c) a nitrogen-containing compound or a metal selected from alkali and alkaline earth metals to provide the lubricant additive component.

10. The method of claim 9, further comprising overbasing the reaction product adduct to provide an overbased alkali or alkaline earth metal salt adduct.

11. The method of claim 9, wherein component (b) is selected from the group consisting of maleic acid or anhydride, succinic acid or anhydride, and halo-carboxylic acid.

12. The method of claim 9, wherein the amine comprises a mono- or polyamine.

13. A lubricant composition comprising the sulfur-free salt compound of claim 1 and one or more additional additives selected from the group consisting of a polymeric viscosity modifier, a detergent, an antioxidant, a dispersant, a rust inhibitor, an antiwear agent, a boron-containing compound, a friction modifier, a pour-point depressant, and an antifoaming agent.

14. A method for lubricating an internal combustion engine comprising adding the lubricant composition of claim 13 to a crankcase of said engine.

15. The method of claim 14, wherein the engine comprises a heavy duty diesel engine.

16. A lubricating oil concentrate comprising the sulfur-free salt compound of claim 1 and one or more additional additives selected from the group consisting of a polymeric viscosity modifier, a detergent, an antioxidant, a dispersant, a rust inhibitor, an antiwear agent, a boron-containing compound, a friction modifier, a pour-point depressant, and an antifoaming agent.

17. The method of claim 9, comprising neutralizing the reaction product adduct with a basic nitrogen-containing compound to provide an ammonium salt of the reaction product adduct.

* * * * *